US005184105A

United States Patent [19]

Endo

[11] Patent Number: 5,184,105

[45] Date of Patent: Feb. 2, 1993

[54] BOBBIN FOR MULTIPLE-CONNECTED INDUCTOR

[75] Inventor: Kunihisa Endo, Tsurugashima, Japan

[73] Assignee: Toko Kabushiki Kaisha, Tokyo, Japan

[21] Appl. No.: 661,371

[22] Filed: Feb. 28, 1991

[30] Foreign Application Priority Data

May 11, 1990 [JP] Japan ..... 2-49209[U]

[51] Int. Cl.[5] ..... H01F 15/10; H01F 27/30

[52] U.S. Cl. ..... 336/192; 29/602.1; 336/198

[58] Field of Search ..... 336/198, 208, 192, 196; 310/194; 29/602.1, 604, 605, 606, 607

[56] References Cited

U.S. PATENT DOCUMENTS 3,947,796 3/1976 Postma et al. ..... 336/198 X
4,352,079 9/1982 Mueller et al. ..... 336/192

FOREIGN PATENT DOCUMENTS 811414 1/1937 France ..... 336/198
752570 7/1956 United Kingdom ..... 336/198

*Primary Examiner*—Thomas J. Kozma
*Attorney, Agent, or Firm*—Stevens, Davis, Miller & Mosher

[57] ABSTRACT

A bobbin for a multiple-connected inductor characterized in that three flanges or more and winding grooves for coils partitioned by the flanges are formed by synthetic resin, and that a metal piece exposed to the outside at the portion of each flange to serve as an electrode or a connecting portion of coils and a magnetic body extending over a plurality of winding grooves under the state where it is supported by the metal piece are embedded within the synthetic resin. A bobbin for a multiple-connected inductor characterized in that three flanges or more and winding grooves for coils partitioned by the flanges are formed by synthetic resin, and that a rod-shaped magnetic body extending over a plurality of winding grooves and having a cross sectional area caused to be different in a length direction are embedded within the synthetic resin.

7 Claims, 3 Drawing Sheets

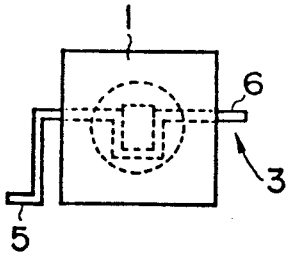
FIG. 1
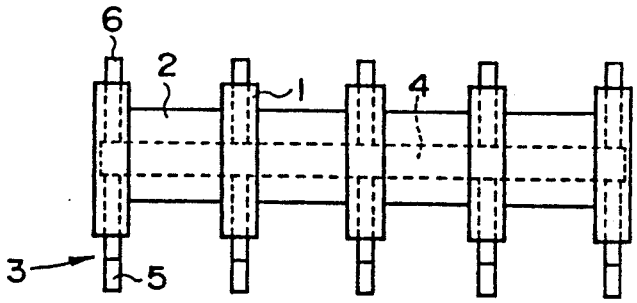
FIG. 2
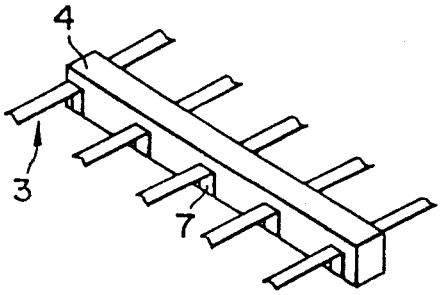
FIG. 3
FIG. 4
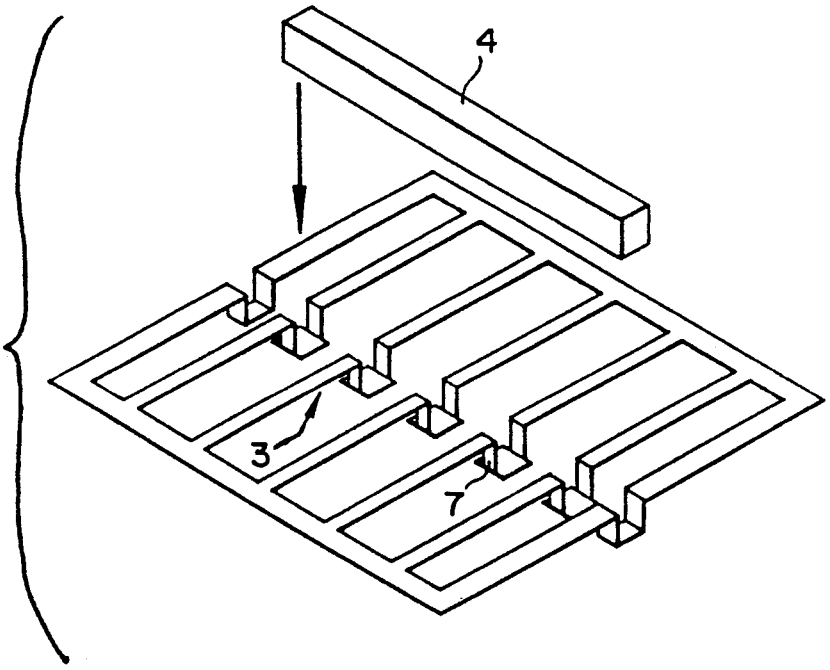

BOBBIN FOR MULTIPLE-CONNECTED INDUCTOR

BACKGROUND OF THE INVENTION

1. Field of Utilization in Industry

This invention relates to a bobbin for a multiple-connected inductor used mainly in the case of constituting a delay line or a filter, and such that coils are separately wound over a plurality of sections.

2. Prior Art

For a bobbin for a multiple-connected inductor of this kind, it is important to precisely set inductance values of respective coils wound thereon and an electromagnetic coupling between coils.

Bobbins are ordinarily formed by sintered ferrite or synthetic resin. Under the present state where bobbins are considerably being miniaturized, when an example of a square flange is taken, since one side of the square flange is 4 mm or less, and the thickness of the flange and/or the width of the winding groove between flanges is 3 mm or less, it difficult to mold, with good yield, by using ferrite, an elongated bobbin in a uniaxial form in which flanges and winding groove are continuous to each other. The trouble that the flange may be partially broken is apt to occur. Further, since the coupling between coils becomes strong, the adjustment of the coupling is difficult.

In the case of synthetic resin, molding is easy, but it is unable to increase the inductance of the coil. A rod-shaped core may be embedded within the synthetic resin. However, since it is difficult to precisely determine the position of the core within the synthetic resin, unevenness in inductance or coupling between coils is apt to occur.

SUMMARY OF THE INVENTION

Objects

An object of this invention is to form a bobbin for a multiple-connected inductor with synthetic resin to thereby facilitate molding of the bobbin.

Further, another object of this invention is to provide a bobbin for a multiple-connected inductor in which a magnetic body extending over a plurality of winding grooves is arranged within the bobbin to increase the inductance of the coil, and to vary the thickness of the flange partitioning the winding grooves, thereby making it possible to precisely set coupling between coils wound in the respective winding grooves.

In addition, a further object of this invention is to provide a bobbin for a multiple-connected inductor in which the cross sectional area of the magnetic body is caused to be partially different in a length direction, thereby making it possible to independently set the inductance of the coil and the strength of coupling between coils.

Means for Solving the Problems

A bobbin for a multiple-connected inductor according to this invention is characterized in that three flanges or more, and winding grooves for coils partitioned by these flanges are formed by synthetic resin, and that a metal piece exposed to the outside at the portion of each of the flanges to serve as an electrode or a connecting portion of coils and a magnetic body extending over a plurality of winding grooves under the state where it is supported by the metal pieces are embedded within the synthetic resin.

The cross sectional area of the magnetic body may be caused to be partially different in a length direction.

BRIEF DESCRIPTION OF THE DRAWINGS

FIG. 1 is a side view showing a first embodiment of a bobbin for a multiple-connected inductor of this invention, FIG. 2 is a plan view, FIG. 3 is a perspective view of the inside, FIG. 4 is an explanatory view at the time of molding.

EMBODIMENTS

Figure 5:
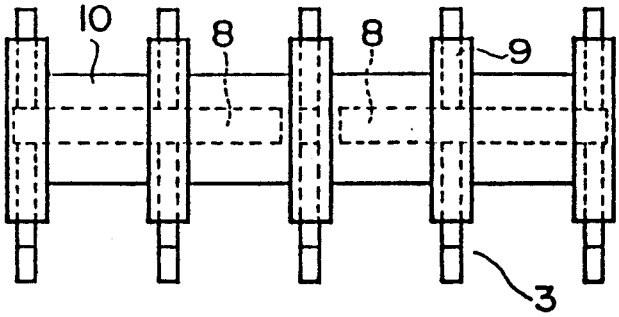
FIG. 5 is a plan view showing a second embodiment of a bobbin for a multiple-connected inductor of this invention.

Explanation will now be given with reference to the side view of FIG. 1, the plan view of FIG. 2, and the inside perspective view of FIG. 3 showing a first embodiment of a bobbin for a multiple-connected inductor of this invention.

In FIGS. 1 to 3, reference numerals 1 denote flanges, respectively, reference numerals 2 winding grooves, respectively, reference numerals 3 metal pieces of non-magnetic body, respectively, and reference numeral 4 a magnetic body comprised of ferrite of an elongated rectangular parallelepiped.

The flanges 1 and the winding grooves 2 are formed by synthetic resin, respectively, and the metal pieces 3 and the magnetic body 4 are embedded within the synthetic resin as indicated by dotted lines. Each metal piece 3 is exposed from the opposite both side surfaces of the flange 1 to the outside to form an electrode 5 for surface connection and a connecting portion 6 of coils. The metal piece 3 is bent U-shaped as shown in FIG. 3. The magnetic body 4 is embedded extending over the entirety in a length direction of the bobbin substantially at the center of the bobbin under the state where the magnetic body 4 is supported by the U-shaped portions 7.

In the case of such a bobbin for a multiple-connected inductor, it is preferable to inject resin into the surrounding portion of the structure including magnetic body 4 fitted into the U-shaped portions 7 of the metal pieces 3 in the state of a lead frame to mold a bobbin, thereafter to cut and separate the metal pieces 3 from the lead frame to apply machining thereto, thus to form electrodes 5 and connecting portions 6.

Since the magnetic body 4 is supported by the metal pieces 3 in the case of such a bobbin for a multiple-connected inductor, there is no possibility that the magnetic body 4 may move by a pressure at the time of injection of resin, thus making it possible to precisely determine the inside position. Since the position is precisely determined, specific permeability of the bobbin is precisely determined. Further, it is possible to precisely set the inductance of the coil by determining the dimension of the winding groove 2 and the winding condition of the coil, and the coupling between coils by the thickness of the flange.

FIG. 5 is a plan view showing a second embodiment of a bobbin for a multiple-connected inductor of this invention wherein two magnetic bodies 8 are embedded. The magnetic resistance becomes large at the flange 9 between magnetic bodies 8. As a result, the coupling between coils in winding grooves 10 on the both sides between which the flange 9 is put is smaller than that in the case where the magnetic body 8 is provided at the flange 9.

As stated above, the number of magnetic bodies to be embedded may be two or more in dependency upon the degree of a required coupling.

Figure 6:
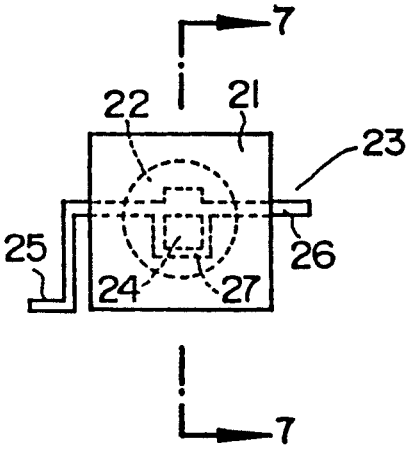
FIG. 6 is a side view showing a third embodiment of a bobbin for a multiple-connected inductor of this invention.
Figure 7:
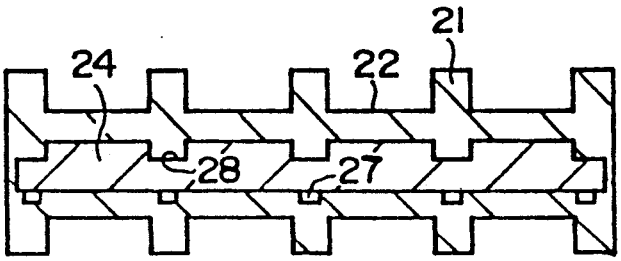
FIG. 7 is a cross sectional view taken along the A—A of FIG. 6.

FIGS. 6 and 7 show a third embodiment of a bobbin for a multiple-connected inductor of this invention. FIG. 6 is a side view, and FIG. 7 is a cross sectional view taken along A—A of FIG. 6.

In FIGS. 6 and 7, reference numerals 21 denote flanges, respectively, reference numerals 22 winding grooves, respectively, reference numerals 23 metal pieces of non-magnetic body, respectively, and reference numeral 24 a magnetic body comprised of rod-shaped ferrite.

The flanges 21 and the winding grooves 22 are formed by synthetic resin, and metal pieces 23 and the magnetic body 24 are embedded within the synthetic resin. Each metal piece 23 is exposed from the opposite both side surfaces of the flange 21 to the outside to form electrodes 25 for surface connection and connecting portions 26 of coils.

Each metal piece 23 is bent U-shaped within the flange 21, and the magnetic body 24 is in the state where it is supported by the bent portions 27.

The magnetic body supported by the metal piece 23 is arranged substantially at the center axis, and is embedded extending over the entire winding grooves. The magnetic body 24 is square in the lateral cross sectional area, but is not uniform in the cross sectional area in a length direction. Namely, at the portion of the flange 21, a recessed portion 28 is provided to reduce the cross sectional area thereof. On the other hand, at the portion of the winding groove 22, no recessed portion 28 is provided to thereby allow the cross sectional area to be larger than that at the portion of the flange 21.

Thus, the magnetic resistance of the magnetic body 24 at the portion of the flange 21 is larger than that at the portion of the winding groove 22. As a result, the coupling between coils wound at winding grooves 23 between which the flange 21 is put is more weak than that in the case where there is no recessed portion 28.

The inductance of the coil wound at the winding groove 22 having no recessed portion 28 undergoes influence given by reducing the cross sectional area of the magnetic body 24 to weaken the coupling between coils. However, this is not problem in practice. If the dimension of the winding groove 22 and the coil winding condition are the same, the magnetic resistance is adjusted by the cross sectional area of the magnetic body 4 at the portion of the winding groove 22, thereby making it possible to set inductance independently of the strength of the coupling. Namely, by adjusting the cross sectional areas of the magnetic body 24 at the portions of the flange 21 and the winding groove 22, the inductance of the coil and the coupling between coils can be independently set, respectively.

Namely, it is not necessary to set the coupling between coils by varying the thickness of the flange as in the first and second embodiments.

Figure 8:
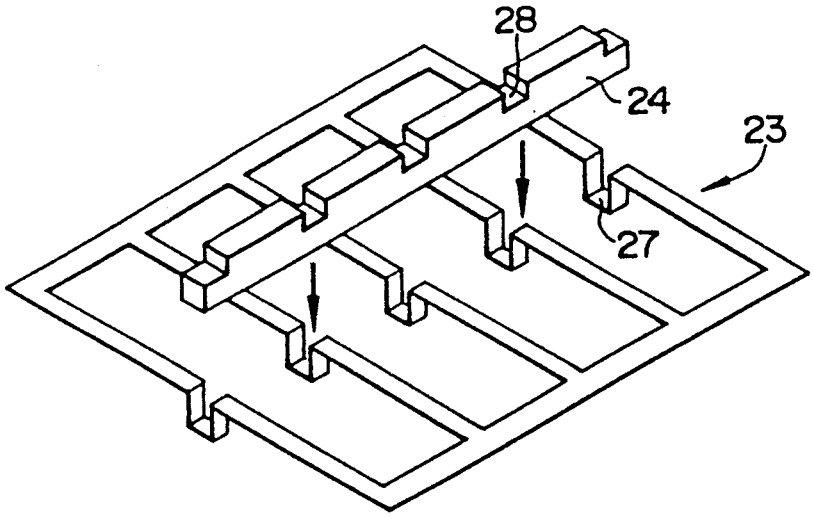
FIG. 8 is an explanatory view.

In the case of such a bobbin for a multiple-connected inductor, it is preferable to inject resin into the surrounding portion of the structure including the magnetic body 24 formed in the bent portion 27 of the metal piece 23 in the state of a lead frame as shown in FIG. 8 to mold a bobbin, thereafter to cut and separate the metal piece 23 from the frame.

Figure 9:
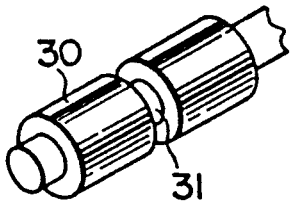
FIG. 9 is a partial perspective view showing another form of the magnetic body.

FIG. 9 is a perspective view showing another form of the magnetic body wherein the peripheral portion of a rod-shaped magnetic body 30 is shaved toward the center, thus to form a recessed portion 31. As stated above, there may be various modifications in respect of the form of the magnetic body obtained by partially varying the cross sectional area.

Figure 10:
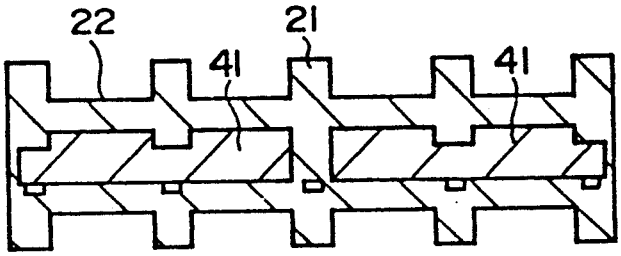
FIG. 10 is a plan view showing a fourth embodiment of a bobbin for a multiple-connected inductor of this invention.

FIG. 10 is a cross sectional view showing a fourth embodiment of a bobbin for a multiple-connected inductor of this invention wherein two magnetic bodies 41 are embedded. Since no magnetic body 41 exists at the flange 21 between magnetic bodies 41, the coupling between coils of the winding grooves 22 on the both sides between which the flange 21 is put is smaller than that in the case where the magnetic body 41 exists at the flange.

It is to be noted that in the case where the cross sectional area of the magnetic body is caused to be different in a length direction, the portion of the flange 21 is constituted so that it is narrower than the winding groove 22, but the dimensional relationship may be reversed according to need, or such portions may be mixed.

Moreover, there are instances where the metal piece 3 or the metal piece 23 forms only the connecting portion exposed from the flange or the electrode which doubles as the connecting portion. Further, the electrode is not only directed to an electrode for surface connection directly connected to the conductive pattern of the circuit substrate, but also may be in the form of a pin which can be inserted into the circuit substrate.

While the metal piece 3 or the metal piece 23 supports the magnetic body at the U-shaped portion 7 or 27, such a metal piece may support the magnetic body in a manner to fix the magnetic body at the flat portion thereof by means of an adhesive.

In addition, the magnetic body may be comprised of synthetic resin into which magnetic powder is mixed, and magnetic powder may be mixed into the flange or the winding groove.

Advantages

As described above, a bobbin for a multiple-connected inductor of this invention is formed by synthetic resin. Thus, the molding is facilitated, thereby making it possible to improve the yield.

Further, the magnetic body extending over a plurality of winding grooves adapted so that coils are wound thereinto is arranged within the bobbin under the state where it is supported by the metal pieces serving as an electrode or a connecting portion of coils, thereby making it possible to precisely determine the position of the magnetic body.

Accordingly, the inductance of the coil in the winding groove and the coupling between coils can be precisely set by permeability and dimension of the magnetic body, and the thickness of the flange, respectively. The magnetic body can be supported by the metal pieces serving as an electrode or a connecting portion of coils without particularly embedding a support body. This is convenient.

Further, by allowing the cross sectional area in a length direction of the magnetic body to be partially different, the inductance of coil and the coupling between coils can be independently set, respectively.

In this way, the bobbin for multiple-connected inductor of this invention makes it possible to precisely set the inductance of the coil and/or the coupling between coils, and to reduce occurrence of breakage or crack at the time of molding to improve yield.

I claim:

1. A bobbin for a multiple-connected inductor comprising:

(a) an elongated member formed of synthetic resin and including at least three flanges and winding grooves for coils partitioned by said flanges;

a metal piece partially embedded in said member and projecting outside said member at a portion of each of said flanges to serve as an electrode or a connecting portion of the coils; and a rod-shaped magnetic body disposed entirely within said member and extending over a plurality of said winding grooves under a state in which said magnetic body is supported by portions of said metal pieces which are entirely embedded within said member formed of synthetic resin.

2. A bobbin for a multiple-connected inductor as set forth in claim 1, wherein said magnetic body has a cross sectional area which varies in a length direction thereof.

3. A bobbin for a multiple-connected inductor as set forth in claim 1, wherein said magnetic body has a cross sectional area which is narrower at portions thereof adjacent said flanges than at portions thereof adjacent said winding grooves.

4. A bobbin for a multiple-connected inductor comprising:

(a) an elongated member formed of synthetic resin and including at least three flanges and winding grooves for coils partitioned by said flanges;

a metal piece partially embedded in said member and projecting outside said member at a portion of each of said flanges to serve as an electrode or a connecting portion of the coils; and a rod-shaped magnetic body disposed entirely within said member and extending over a plurality of said winding grooves under a state in which said magnetic body is supported by U-shaped portions of said metal pieces which are entirely embedded within said member formed of synthetic resin.

5. A bobbin for a multiple-connected inductor as set forth in claim 1, wherein said rod-shaped body is formed of a plurality of magnetic bodies embedded within the synthetic resin.

6. A bobbin for a multiple-connected inductor as set forth in claim 2, wherein said rod-shaped body is formed of a plurality of magnetic bodies embedded within the synthetic resin.

7. A bobbin for a multiple-connected inductor as set forth in claim 3, wherein said rod-shaped body is formed of a plurality of magnetic bodies embedded within the synthetic resin.

* * * * *